United States Patent [19]

Molino

[11] Patent Number: 4,669,414

[45] Date of Patent: Jun. 2, 1987

[54] SWIM PLATFORM WITH UNIVERSAL MOUNTING SYSTEM

[76] Inventor: Joseph L. Molino, #2 Aura Dr., Valley Cottage, N.Y. 10989

[21] Appl. No.: 830,718

[22] Filed: Feb. 19, 1986

[51] Int. Cl.[4] ..... B63B 17/00

[52] U.S. Cl. ..... 114/343; 114/362

[58] Field of Search ..... 114/343, 362; 182/53, 182/55, 150

[56] References Cited

U.S. PATENT DOCUMENTS 2,601,888 7/1952 Schopper ..... 182/53

3,613,137 10/1971 Eccles ..... 114/362

4,495,883 1/1985 Hoy ..... 114/362 X

*Primary Examiner*—Sherman D. Basinger

*Attorney, Agent, or Firm*—Dennis L. Kreps

[57] ABSTRACT

A universal mounting system for attachment of a swim platform or the like to the transom of a boat, including mounting feet attached to telescoping support members which allow both longitudinal and rotational translation of the mounting brackets in order to accommodate any transom configuration, shape or angle. Two embodiments are shown, one with a three-piece swim platform deck for use with inboard/outboard engines, and another with a one-piece deck for other boat designs.

5 Claims, 6 Drawing Figures

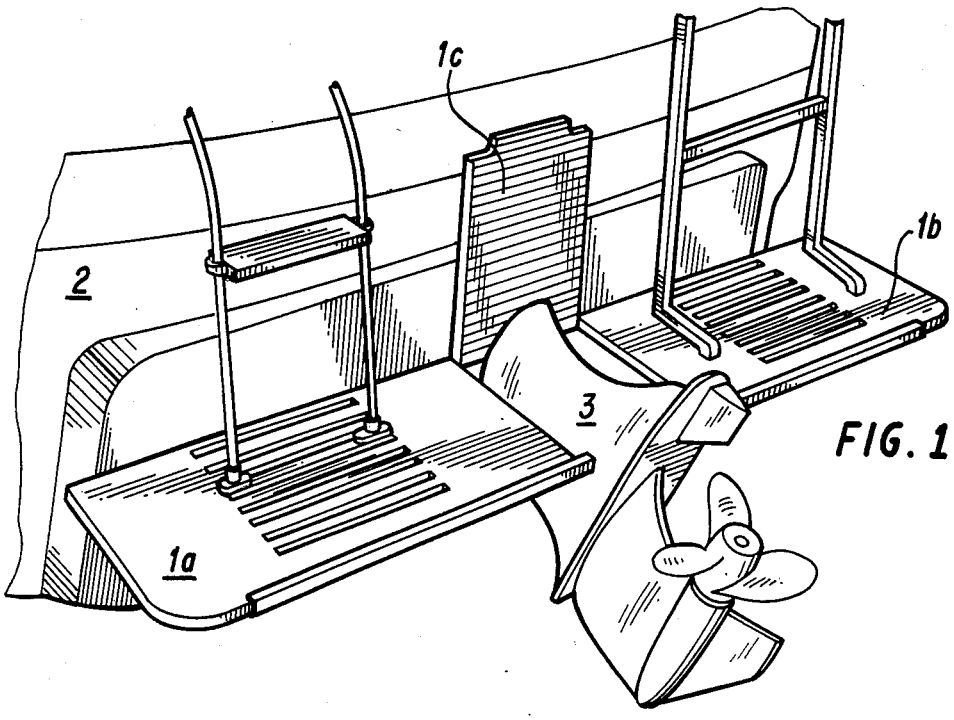
FIG. 1
FIG. 2
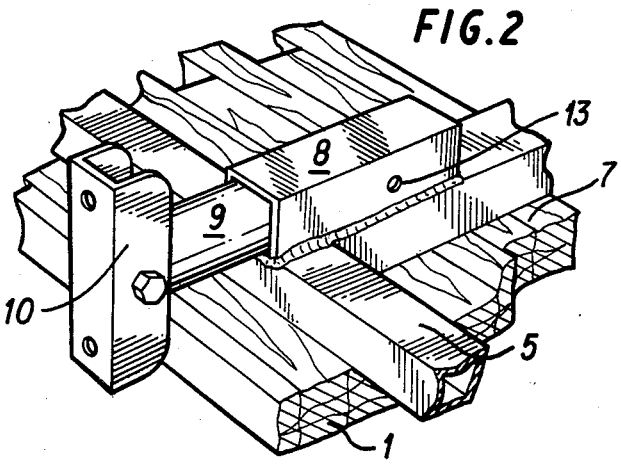
FIG. 3
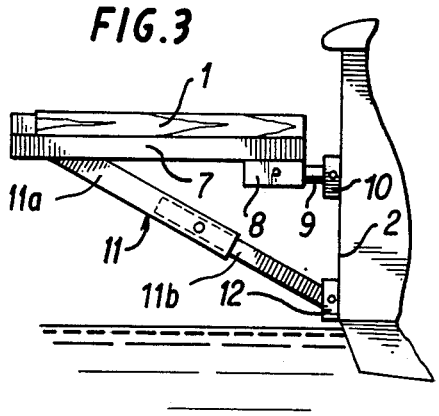
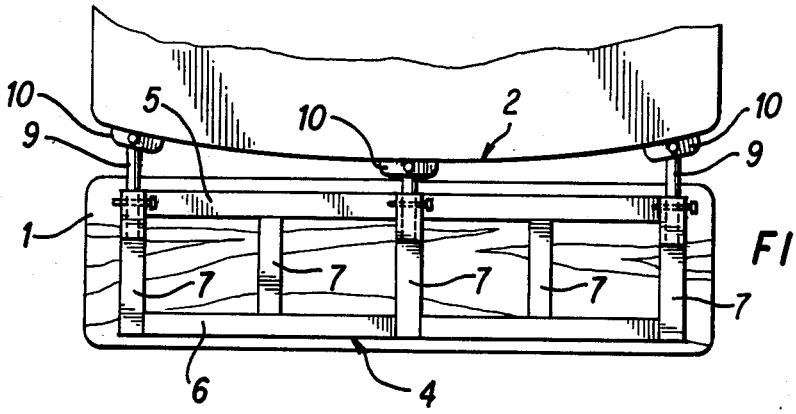
FIG. 4

SWIM PLATFORM WITH UNIVERSAL MOUNTING SYSTEM

BACKGROUND OF THE INVENTION

Increasing leisure time in our modern world has led to an increase in many different types of leisure time activities. One activity currently enjoying increased popularity is pleasure boating.

Boats can provide families with a variety of water-related activities, such as fishing, swimming and water skiing. Each type of activity provides the opportunity for a boat owner to modify his craft with accessories which can make his chosen activity more enjoyable. However, not all accessories are adaptable for installation on all boats.

In the case of fishing accessories, most are designed to be universal, i.e., adaptable for installation and usage on all boats.

Accessories relating to swimming and water skiing are not so adaptable. One common accessory for such activities is a swim platform for attachment to the transom at the rear of the boat to facilitate ingress and egress between the boat and the water. Most boats are designed with rather tall gunwales and sterns, both for the safety of the passengers and to preclude swamping of the boat during rough weather. This makes climbing into the boat from the water difficult at best for swimmers and water skiiers returning to the boat. A swim platform, rigidly attached to the boat transom, usually just above the water line, greatly facilitates climbing back into the boat.

DESCRIPTION OF THE PRIOR ART

In the past, with the multitude of different transom configurations, shapes and angles in existance, it has been necessary for each swim platform to be custom-designed for a single boat model. Witness the extreme curvature of the platform shown in U.S. Pat. No. 3,613,137 to William Eccles, patented Oct. 9, 1971, or the requirement for a perfectly straight platform in U.S. Pat. No. 4,085,473 to Dwaine R. Franklin, patented Apr. 25, 1978. In the past, there was no comprehensive universal mounting means to allow attachment of a single-design swim platform to a majority of transom configurations.

SUMMARY OF THE INVENTION

It is an object of this ivention to provide a swim platform with a universal mounting system capable of accommodating most, if not all, transom configurations currently in existence.

It is another object of this invention to provide a mounting system for a swim platform or the like with a rigid frame to support the platform, and bracketing and support means capable of telescopic and pivotal adjustment to allow securement to any boat transom, regardless of configuration, shape or angle.

It is another object of this invention to provide a centrally located, hingedly mounted center section in a swim platform to allow the use of a full-width platform on a boat powered by an inboard/outboard engine without interfering with movement of the stern drive unit.

It is yet another object of this invention to provide a filler kit to enable custom fitting of said platform to any transom shape or configuration.

BRIEF DESCRIPTION OF THE DRAWINGS

FIG. 1 is a perspective view of embodiment of the swim platform of the invention incorporating a hinged center section for use with inboard/outboard engine-powered boats.

FIG. 2 is a perspective view of part of the adjustable mounting of the invention.

FIG. 3 is a side plan view of the invention attached to the transom of a boat.

FIG. 4 is a bottom plan view of one embodiment of the invention attached to the transom of a boat.

DETAILED DESCRIPTION OF THE INVENTION

Figure 5:
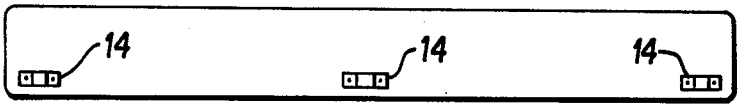
FIGS. 5 and 6 are bottom plan views of the filler kit used to adapt the shape of the swim platform inner edge to any shape or configuration of boat transom, before and after shaping, respectively.
Figure 6:
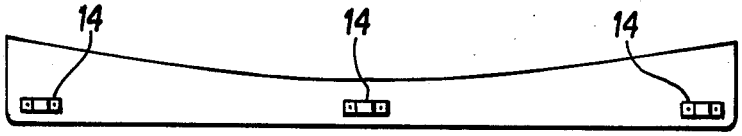

Referring now to FIG. 1, a first embodiment of the invention is illustrated. A three-piece swim platform 1*a*, 1*b*, 1*c* is shown attached to the transom 2 of a boat powered by an inboard/outboard engine. To accommodate the stern drive assembly 3 when it is in its raised position (as shown), a center section of the outer elongate member 6 of the rigid frame 4 (shown in FIG. 4) which supports the swim platform 1*a*, 1*b*, 1*c* is removed, and the forward edge nearest the transom 2 of center platform section 1*c* is hingedly attached to the inner elongate member 5 of rigid frame 4 to facilitate raising and lowering of stern drive unit 3 in an unimpeded fashion, while still providing a full-width swim platform when the stern drive 3 is lowered.

A second embodiment of the invention, showing a standard one-piece swim platform 1, is illustrated in FIG. 4. This is a bottom plan view of the platform to better illustrate the construction of rigid frame 4 which supports swim platform 1. Rigid frame 4 is comprised of inner and outer elongate members 5 and 6, respectively, with inner member 5 being mounted adjacent the boat transom 2, and outer member 6 being located adjacent the outer edge of swim platform 1. These elongate members 5 and 6 are interconnected by a plurality of spreader members 7, with all joints welded to produce a rigid frame 4. Stainless steel tubing of square cross-section is utilized for all frame members.

It will be obvious to one skilled in the art that the particular frame 4 shown in FIG. 4 is adapted for use with a one-piece swim platform. To provide the stern drive embodiment of FIG. 1, an even number of spreader members 7 should be used in frame 4 to allow removal of the center section of elongate member 6 without seriously affecting the rigidity of the frame. Likewise, it is obvious that three or more transom mounts, depending on the size of the swim platform, are needed for a one-piece platform as shown in FIG. 4, but four mounts are necessitated for the three-piece platform of FIG. 1.

The novel mounting system which allows either embodiment of the swim platform to be adapted and mounted to any transom configuration, shape or angle is best shown in FIGS. 2 and 3. Welded to the inner end of several of the spreader members 7 (three, four or more, depending on the embodiment) are channel members 8, formed of the same square cross-section stainless steel tubing as the frame members 5, 6 and 7. These channel members 8 are welded flush with the vertical side of elongate member 5 which is closest to the boat transom 2. Slidably mounted within channel member 8 is tubular support member 9. Formed of stainless steel tubing of circular cross-section, support member 9 is sized for a close fit within channel 8, allowing just enough clearance for longitudinal and rotational translation of support 9 within channel 8.

Attached to the exposed end of support 9, immediately adjacent transom 2, is a stainless steel mounting foot 10, pivotally attached to support 9 by a bolt and nut. The combination of longitudinal and rotational translation allowed support 9 within channel 8 allows mounting foot 10 to be securely attached to any transom, regardless of its configuration, shape or angle. Once the proper position of tubular support 9 within channel member 8 is determined for a particular installation, a horizontal hole is drilled through support 9, using hole 13 in channel 8 as a guide, and a bolt and nut are placed therethrough to secure the mounting system in its required position.

Additional support for vertical loading of swim platform 1 is provided by angle support arms 11 and mounting feet 12. A tubular angle support arm 11 and mounting foot 12 are associated with each channel member 8 and tubular support 9. The outer end of each tubular angle arm 11 is pivotally attached by bracket means (not shown) at the outer end of spreader 7, adjacent outer elongate frame member 6. The inner end and foot 12 are secured to the lower portion of transom 2.

To provide a universal mounting capability for these angle support arms 11 similar to that allowed by the construction of supports 9 within channels 8, angle support arms 11 may be formed of two telescoping parts, 11*a* and 11*b*, as illustrated in FIG. 3. This will allow angular adjustment of arms 11 by lengthening or shortening the arms by telescoping of parts a and b, and also allow swivelling of foot 12 for universal rotational and lateral movement at the end of arm 11 to accommodate any available mounting location on the boat transom 2. Once the best mounting position is determined, and foot 12 is secured to the transom 2, angle arm members 11*a* and 11*b* may be secured with a through -hole and nut and bolt, as with supports 9 and channels 8 above.

The method of mounting either embodiment of the swim platform described above is identical. First, the platform 1 must be supported in the location adjacent transom 2 in which it is to be mounted. Then tubular support members 9 and associated mounting feet 10 are extended longitudinally from and rotated within channel members 8 until secure mounting locations and positions on transom 2 are found. Next, mounting feet 10 are secured to transom 2 by appropriate means. Once this is done, tubular supports 9 are drilled through guide holes 13 in channel members 8, and nuts and bolts are utilized to secure the swim platform to the transom. Finally, locations are found for the mounting feet 12 on angle support arms 11, and feet 12 are likewise secured to transom 2.

Once the swim platform is installed on a boat, it may be quickly and easily removed as necessary for winter storage, stern drive unit servicing or the like, by simply unbolting all of the pivot mounting bolts at mounting feet 10 and 12, and it may likewise be reinstalled in a reverse manner.

The preferred materials for the invention, while not limiting the scope thereof, are teakwood for the swim platform deck and stainless steel for all hardware, including the square section frame members, tubular support arms, channel members, mounting feet, angle support arms, nuts and bolts. Heliarc welding is used for all weld joints to insure strength and durability.

To further customize the swim platform installation, a curve filler kit has been designed to fill in the space between the swim platform inner edge and the curved or irregular transom surface. This is particularly important from a safety standpoint if the space is large enough to allow a swimmer's or skier's foot to slip through while climbing out of or into the boat.

The curve filler kit comes in a rectangular shape as shown in FIG. 5. With the curve filler placed in its desired location at the rear of the boat, with the centers of the kit and transom aligned, a compass or scribe can be used to trace the precise shape of the transom onto the curve filler kit. The kit can then be cut and sanded to exactly match the boat transom curvature.

Brackets 14 mounted on the bottom of the curve filler kit are designed to receive tubular support arms 9 prior to their attachment to mounting feet 10, and thus the curve filler kit is attached to the boat at the same time the swim platform is secured thereto. Once proper placement is determined, brackets 14 and support arms 9 may be through-drilled and bolted for additional rigidity.

I claim:

1. In a swim platform for securement to the transom of a boat, a universal mounting system to allow attachment of said platform to any boat transom, regardless of its specific shape and design, said mounting system including:

a rigid frame secured to the underside of the said swim platform, said frame comprised of two elongate members mounted normal to the center longitudinal axis of the boat and in the horizontal plane, the first of said members secured along the edge of said platform adjacent said transom, and the second of said members secured along the opposite, outer edge of said platform, and a multiplicity of shorter members mounted parallel to the center longitudinal axis of the boat and secured at each end to said elongate members;

separate channel members secured at several spaced locations to said first elongate member located adjacent the boat transom;

tubular support members mounted telescopically within said channel members;

foot members pivotally attached to said tubular support members for direct attachment to said transom; and a plurality of angled support members pivotally attached to said second elongate frame member secured along the outer edge of said platform, and provided with foot members pivotally attached to the opposite ends thereof for direct attachment to said transom.

2. A swim platform universal mounting system as described in claim 1, wherein:

a curve filler kit is provided to fill the gap between the edge of said platform adjacent said transom and the irregular surface of said transom, said curve filler kit being secured to said tubular support members mounted telescopically within said channel members.

3. In a swim platform for securement to the transom of a boat, a universal mounting system to allow attachment of said platform to any boat transom, regardless of its specific shape and design, said mounting system including:

a rigid frame secured to the underside of the said swim platform, said frame comprised of two elongate members mounted normal to the center longitudinal axis of the boat and in the horizontal plane, the first of said members secured along the edge of said platform adjacent said transom, and the second of said members secured along the opposite, outer edge of said platform, and a multiplicity of shorter members mounted parallel to the center longitudinal axis of the boat and secured at each end to said elongate members;

separate channel members secured at several spaced locations to said first elongate member located adjacent the boat transom; tubular support members mounted telescopically within said channel members;

foot members pivotally attached to said tubular support members for direct attachment to said transom; and a plurality of angled support members pivotally attached to said second elongate frame member secured along the outer edge of said platform, and provided with foot members pivotally attached to the opposite ends thereof for direct attachment to said transom;

said second elongate member secured along the opposite, outer edge of said platform being modified by removal of a central portion of said member, and said swim platform being comprised of three parts, two equal and larger parts mounted on the left and right outer ends of said rigid frame, and a smaller center part hingedly attached to said first elongate member at the side thereof which is adjacent said transom.

4. A swim platform universal mounting system as described in claim 3, wherein:

said separate channel members secured at spaced locations to said first elongate member located adjacent the boat transom are square in cross section.

5. A swim platform universal mounting system as described in claim 3, wherein:

said separate channel members and said tubular support members mounted telescopically within said channel members are secured to one another by means of horizontally drilling a hole through each of said channel and tubular support pairs, and bolting each of said pairs together with a bolt placed through said hole and a nut threaded thereon, said bolting being performed after said tubular support members and said pivotally mounted foot members associated therewith have been attached directly to said boat transom.

* * * * *